US006759967B1

(12) United States Patent
Staller

(10) Patent No.: US 6,759,967 B1
(45) Date of Patent: Jul. 6, 2004

(54) REMOTE CONTROL FOR ACTIVATING HOUSEHOLD VIDEO PRODUCTS AND SERVICES

(75) Inventor: Joshua D. Staller, Littleton, CO (US)

(73) Assignee: Qwest Communications International, Inc., Denver, CO (US)

( * ) Notice: Subject to any disclaimer, the term of this patent is extended or adjusted under 35 U.S.C. 154(b) by 0 days.

(21) Appl. No.: 09/523,863

(22) Filed: Mar. 14, 2000

(51) Int. Cl.[7] ..... G08C 19/00

(52) U.S. Cl. ..... 340/825.72; 364/138; 342/44; 348/734

(58) Field of Search ..... 364/138, 551.02, 364/468; 340/572, 825.54, 825.72, 679, 825.55; 342/44; 348/734

(56) References Cited

U.S. PATENT DOCUMENTS 5,410,326 A * 4/1995 Goldstein ..... 348/134

6,407,779 B1 * 6/2002 Herz ..... 348/734

* cited by examiner

*Primary Examiner*—Michael Horabik
*Assistant Examiner*—M Shimizu
(74) *Attorney, Agent, or Firm*—Townsend and Townsend and Crew LLP

(57) ABSTRACT

A remote control, particularly for a home entertainment system, includes a display screen generating a query regarding the status of the components. The status may include whether the component is on or off or whether media is in a media player. The remote control receives user input indicating the status of the components in response to the query from the remote control. The remote control further includes a transmitter for generating the control signal to the component based upon the indication of the component status from the user.

18 Claims, 3 Drawing Sheets

REMOTE CONTROL FOR ACTIVATING HOUSEHOLD VIDEO PRODUCTS AND SERVICES

BACKGROUND OF THE INVENTION

The present invention relates generally to a controller for household electronic devices and more particularly to a remote control for a home entertainment system.

In recent years, the number of components and services available for a home entertainment system has grown, including VCRs, DVDs, videogames, picture-in-picture, cable, satellite, etc. With this increase in the number of components and services available, the number of permutations of possible configurations of these components and services has increased dramatically to include displaying a video signal from one component while recording a video signal from a different component, watching video signals from different components using picture-in-picture, etc.

A known remote control simplifies the process somewhat by being programmable to operate each of the different components and services even though they utilize different protocols, frequencies and different types of receivers (i.e., infrared, RF, etc.). The known remote control also simplifies some processes through the utilization of macros which can be programmed to operate a plurality of the components and services. For example, activating a "watch VCR" macro would cause the known remote control to (1) turn the TV on, (2) turn the TV to channel 3, (3) turn the VCR on. However, this remote control macro assumes the initial state of all of the components, in particular that TV and VCR are off, and the VCR has a tape in it. Because the on/off switches in most of these components are toggle switches, if the component is already on, it will be turned off by the macro. As another example, the remote control assumes that the videotape is in the VCR, which may not be true. Thus, the known remote control will not always work, depending on the initial status of the components and services.

SUMMARY OF THE INVENTION

The present invention provides a controller for a home entertainment system that provides more consistent results by generating a status query regarding the initial status of the components and services. Based upon a response to the status query, the controller of the present invention operates the components and services consistently and reliably.

In a preferred embodiment, the controller is a remote control for a home entertainment system. The remote control includes an output device, such as a display screen, generating the status query regarding the status of at least one component. The remote control further includes a user input device by which the user responds to the query from the remote control to indicate the status of the components. The remote control further includes a transmitter for generating the control signal to the component based upon the indication from the user of the status of the component. In this manner, the controller generates a consistent, reliable result and is easier to use than the known control device.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF A PREFERRED EMBODIMENT

Figure 1:
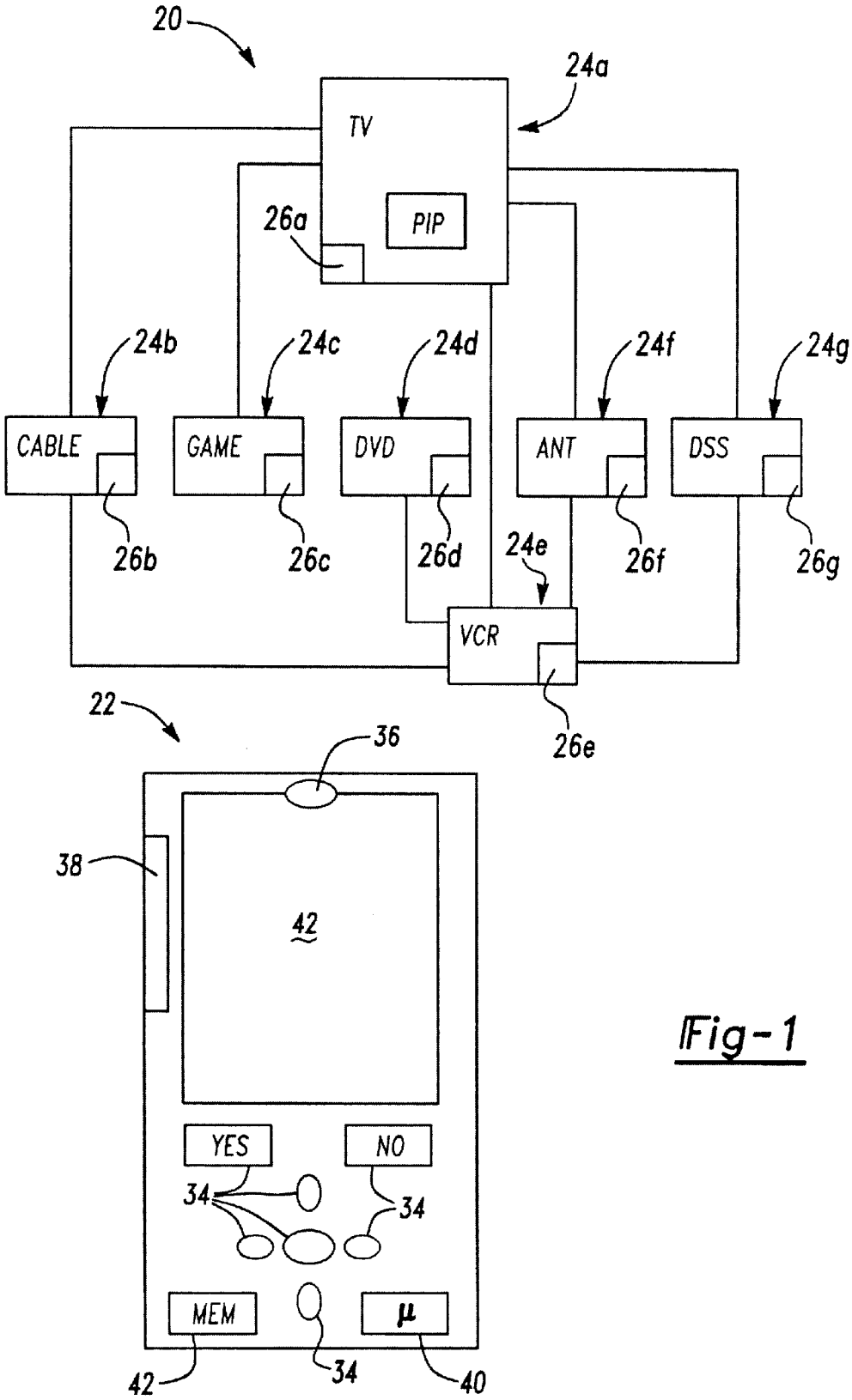
FIG. 1 schematically illustrates the remote control of the present invention and a typical home entertainment system.

FIG. 1 schematically illustrates a home entertainment system 20, including the remote control 22 of the present invention. The home entertainment system 20 includes a plurality of components 24, some of which are associated with specific services (such as cable and digital satellite system subscriptions). The components 24 for illustrative purposes only and not by way of limitation, include a television 24*a*, cable system decoder 24*b*, videogame system 24*c*, DVD player 24*d*, VCR 24*e*, antenna 24*f* and digital satellite system 24*g*. Other video and/or audio components could also be included in the home entertainment system 20. Each of the components 24*a–g* includes a remote control receiver 26*a–g*, respectively. These receivers 26 may operate at different frequencies with different protocols and may be different types (infrared, RF, etc.).

The number of possible different configurations of even these exemplary components 24 is almost endless; however, for purposes of illustration, each of the components 24*b–g* is shown connected to a different input of the television 24*a*, and each of the components 24*b–d, f, g* is also connected to a different input on the VCR 24*e*. The television 24*a* includes a display screen 28, including picture-in picture (PIP) 30.

As should be appreciated, even after the home entertainment system 20 is connected and a configuration selected, the permutations of possible operating configurations are also numerous. Each of the components 24*b–g* can be displayed on the display screen 28 of the television 24*a*, while any of the remaining components 24*b–g* can be displayed on the (PIP) 30, while a further remaining component 24*b–d, f, g* can be recorded on the VCR 24*e*. This involves making sure the correct components 24 are turned on, selecting the proper inputs for the display screen 28 and PIP 30 of the television 24*a*, and selecting the proper input to the VCR 24*e*.

The remote control 22 of the present invention simplifies this process for the user by handling all the necessary steps and ensuring all the needed components 24 are powered, correct inputs selected, and correct operations performed. The remote control 22 includes the features of other known programmable remotes in that it includes user operable input devices 34, such as buttons, including a "YES" button and "NO" button. The remote control 22 also includes wireless transceivers, such as an infrared transceiver 36 and an RF transceiver 38. The remote control 22 preferably includes a microprocessor 40 and memory 42, such a RAM, ROM, EEPROM, flash memory, or any electrically, magnetically or optically stored memory. The memory includes a program, which when executed by the microprocessor 40, performs the functions described herein in a manner known to those skilled in the art. The remote control 22 further includes a display screen 42, such as LCD, LED, gas plasma, or other technology.

It is noted that some known personal digital systems (PDAs) already include the above hardware (other than the RF transceiver 38), and thus could be programmed to operate according to the present invention. Further, some of the known PDAs are expandable, and thus could also be fitted with the RF transceiver 38. Again, the microprocessor 40 is executing a program stored in the memory 42 which performs the functions described below with respect to FIGS. 1–5. The details of the programming would be known to those skilled in the art, given the disclosure of the invention herein.

Figure 2:
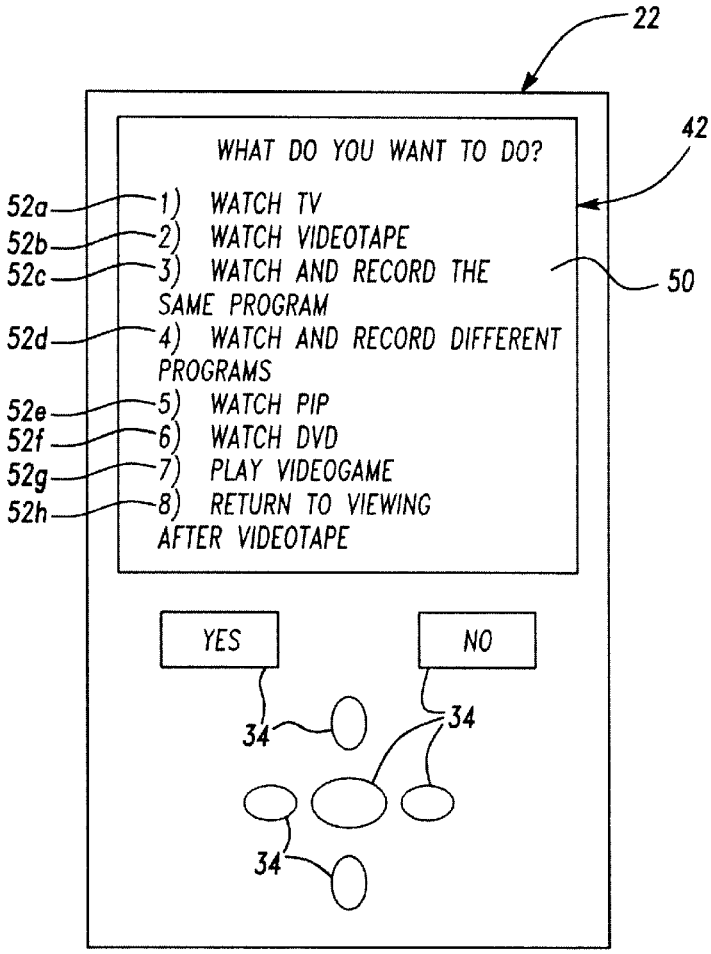
FIG. 2 illustrates the remote control of FIG. 1 displaying a script selection screen.

The advantages of the remote control 22 of the present invention when used in the home entertainment system 20 will be described with respect to FIGS. 2 and 3. FIG. 2 illustrates the remote control 22 displaying a script selection screen 50 displaying a list of previously stored scripts 52*a–h*. Each script 52 represents a predefined viewing function such as watch TV 52*a*, watch videotape 52*b*, watch and record the same program 52*c*, watch and record different programs, 52*d*, watch a picture-in-picture 52*e*, watch a DVD 52*f*, play a videogame 52*g*, return to TV viewing after watching a videotape 52*h*, etc. The scripts 52 are displayed generally as a menu, one or more of which is selected by the user activating the user input buttons 34 on the remote control 22. It should be noted that selection of some of the scripts 52 may lead to further submenus requesting additional information from the user, such as selection of components 24, selecting channels, etc.

Figure 3:
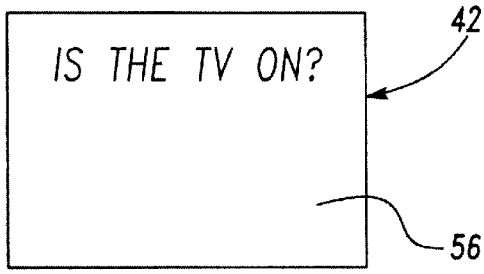
FIG. 3 illustrates the remote control of FIG. 2 displaying the status query screen.

Subsequent to the selection of one of the scripts 52, the remote 22 may display the status query screen 56 shown in FIG. 3. In the status query screen 56, the remote 22 requests status information regarding one of the components 24 (FIG. 1) from the user. Because the components 24*a–d* have on/off power switches which are toggle switches, the remote 22 cannot send an "on" command or an "off" command, the remote 22 can only toggle the components 24 between on and off. In order to place any of the components 24 in a desired state, the initial status of the component must be known. In the present invention, the status query screen 56 performs this function. After the user provides the status input using the "YES" and "NO" buttons 34 (FIG. 2), the remote control 22 can place the component in the desired state. For example, if the user indicates that the component is already on, the remote control 22 need not send the "on/off" toggle command; however, if the user indicates that the component 24 is off, then the remote control 22 sends the "on/off" toggle command to the component 24 in question.

Figure 4:
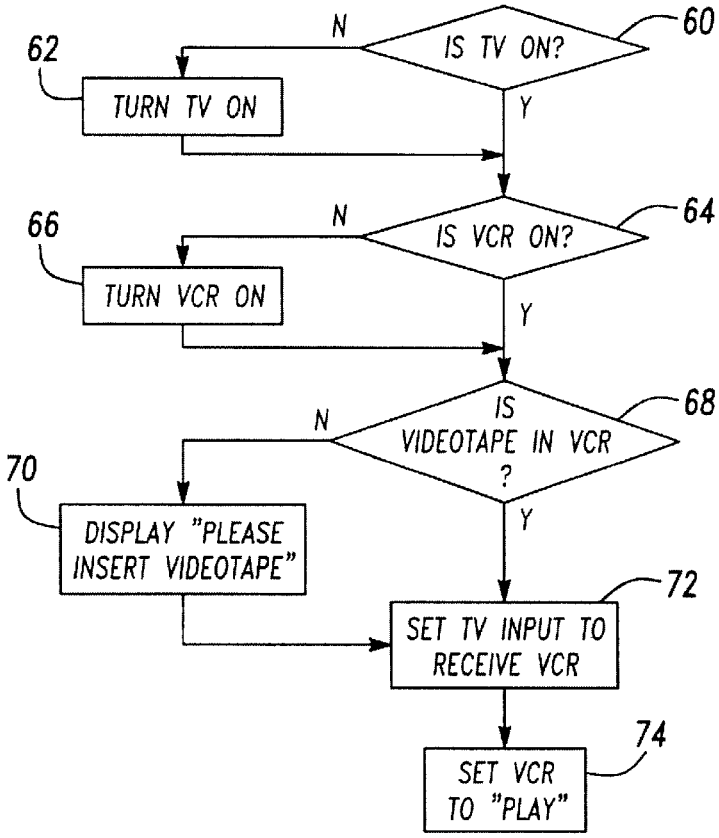
FIG. 4 is a flow chart of one possible script for use in the remote control of FIG. 1.

FIG. 4 illustrates a flow chart for the operation of the script watch a videotape 52*b* script. In step 60, the remote control 22 generates a status query screen 56 (such as in FIG. 3) inquiring whether the television 24*a* is on. The remote control 22 then receives the user input signal via the "YES" and "NO" buttons 34 indicating the status of the television 24*a* ("yes" or "no"). If a "yes" input signal is received, then the remote control 22 does not toggle the power switch of the television 24*a*, but proceeds directly to step 64. If a "no" input signal is received, then the remote control 22 sends a wireless signal to the television 24*a* toggling the power of the television 24*a* "on" in step 62 before proceeding to step 64.

After ensuring that the television 24*a* is on, the subsequent status query screen is generated by remote control 22 inquiring whether the VCR 24*e* is on in step 64. If a "yes" input signal is received, then the remote control 22 does not toggle the power switch of the VCR 24*e*, but proceeds directly to step 68. If the user indicates that the VCR 24*e* is off via the "NO" button 34, the remote control 22 sends the wireless command signal to the VCR 24*e* to toggle to the power on state in step 66.

Another type of status inquiry is then generated by the remote control 22 in step 68 as to whether the tape is in the VCR 24*e*. If a "yes" input signal is received from the "YES" button 34, the remote control 22 proceeds directly to step 72. If the user indicates "no," then the remote control 22 displays the text "please insert the videotape" on display screen 42 in step 70 before step 72.

The remote control 22 then sends a wireless signal to the television 24*a* setting the input to the VCR input in step 72. Finally, the remote control 22 sends a wireless signal to the VCR 24*e* to play the videotape in step 74.

The details of the remaining scripts 52 in FIG. 2 and others should be apparent based upon the disclosure herein. Appropriate status inquiry screens similar to that shown in FIG. 3, such as "is the DVD in the DVD player?" would also be generated where appropriate. The various scripts, including the script shown in FIG. 4 are stored in memory 42. The script is then executed by the microprocessor 40 to perform the functions described herein.

Figure 5:
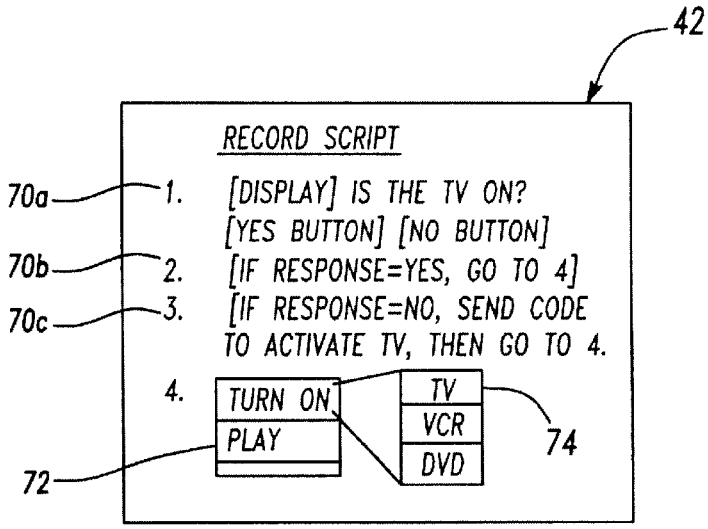
FIG. 5 illustrates one possible screen for the remote control of FIG. 1 for recording a script.

Preferably, the scripts 52 can be created on the remote control 22 itself, through a series of appropriate screens and menus. One possible screen is shown in FIG. 5, when the remote control 22 is placed in a "record script mode." The record script mode may be similar to a line editor for generating a series of program lines 70*a–c*. The program lines 70 may be entered sequentially via a series of menus 72 and submenus 74. Preferably, the scripts can be created by the consumer for the consumer's own entertainment system 20. Alternatively or additionally, the script can be provided by a technician during installation of the entertainment system 20 at the consumer's house. Further scripts may be downloadable over a computer network, such as the Internet, in a manner similar to that currently used for adding software to PDAs. Scripts may be transmitted to the remote control 22 via the infrared transceiver 36 or the RF transceiver 38. Again, if the remote control 22 is a PDA, the PDA may already include the RF transceiver 36 for performing this function.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, one of the components 24, such as the television 24*a*, could output the query regarding the status of other components 24 or the status of whether the media is in the component 24 (e.g. "is the tape in the VCR?"). The component 24 would output the query in response to a wireless signal from the remote control 22.

Further, the query can be generated audibly to the user rather than visually (whether from the remote control 22 or from a component 24). Similarly, the response to the query by the user can also be audible, possibly using voice-recognition technology.

It should also be noted that the invention is not limited to any particular technology on the preferred embodiment of the remote, such as infrared, RF, LCD, RAM, or the technology of the components 24 such as the television 24*a*, VCR 24*e*, DVD player 24*d*, etc. Further, although the terms "on" and "off" have been used herein to refer to states of the components 24, it is well-known that the "off" state of these components 24 could be a low-power or sleep state.

What is claimed is:

1. A remote control for electronic devices comprising:

an output device displaying a list of previously stored scripts, each script representing a predefined function to be performed using at least one electronic device having an on/off toggle switch;

a user input device from which a first input is generated by the user to select a script;

said output device generating a query communicated to the user regarding the initial on/off status of the electronic device in response to said first input from the user input device, a second user input being generated in response to said query and indicating the initial on/off status of the electronic device; and a transmitter transmitting a wireless control signal to the electronic device to toggle the on/off switch to "on" if the second input from the user input device after the query indicates that the electronic device is "off".

2. The remote control of claim 1 wherein the output device is a display.

3. The remote control of claim 1 wherein the transmitter includes an infrared transmitter.

4. The remote control of claim 1 wherein the user input device includes at least one button.

5. A method for controlling at least one electronic device including the steps of:

a) displaying a script in a user output device that represents a predefined function to be performed using at least a first electronic device having an on/off toggle switch;

b) receiving a user input selecting the script;

c) communicating to the user a first status query determined by the script and pertaining to the initial on/off status of the first electronic device;

d) receiving a user input responding to the first status query; and e) transmitting a control signal to the first electronic device to toggle the on/off switch to "on" if the response to the first status query indicates that the first electronic device is "off".

6. The method of claim 5 further including the steps of:

f) receiving at least a second query determined by the script and pertaining to a second electronic device;

g) receiving a user input responding to the second query; and h) transmitting a control signal to the second electronic device based upon the response to the second query.

7. The method of claim 5 wherein said step e) includes the step of sending a first wireless signal to the first electronic device.

8. The method of claim 6 wherein said first electronic device is a video display.

9. The method of claim 8 further including the steps of:

i) playing a pre-recorded media on the second electronic device to generate a video signal; and j) sending the video signal to the video display.

10. The method of claim 9 wherein the user input responding to the second query indicates whether the prerecorded media is in the second electronic device.

11. The method of claim 6 further including the step of:

i) storing a plurality of scripts in the user output device and displaying a list of the scripts in the user output device.

12. A method for remotely controlling at least one electronic device including the steps of:

a) displaying a list of predefined functions involving at least a first electronic device having an on/off toggle switch;

b) receiving a first user selection input selecting a function from the list;

c) requesting a first user status input indicating an on/off status of the first electronic device in response to said step b);

d) receiving the first user status input indicating an on/off status of the first electronic device; and e) transmitting a wireless first control signal to toggle the on/off switch of the first electronic device to "on" if the user status input indicates that the first electronic device is "off".

13. The method of claim 12 further including the steps of:

requesting a second user status input in response to said step b);

receiving a second user status input indicating a status of a second electronic device; and transmitting a wireless second control signal to the second electronic device based upon the second user status input.

14. The method of claim 13 wherein said first electronic device is a video display.

15. The method of claim 14 further including the steps of:

playing a pre-recorded media on the second electronic device to generate a video signal; and sending the video signal to the video display.

16. The method of claim 15 wherein the second status input indicates whether the pre-recorded media is in the second electronic device.

17. A method for remotely controlling at least one electronic device including the steps of:

a) creating a sequence of steps to be performed by a remote control to accomplish a viewing function involving at least one electronic device having an on/off toggle switch;

b) storing the sequence of steps in the remote control;

c) receiving a first user request to perform the function; and d) executing the sequence of steps including making at least one status query to the user regarding the initial on/off status of the electronic device, receiving at least one user status input in response to the status query to the user, and transmuting a wireless first control signal to the electronic device to toggle the switch to "on" if the user status input indicates that the electronic device is "off".

18. An entertainment system comprising:

a video display and a first video player sending a video signal to the video display; each of said video display and first video player having an on/off toggle switch;

a remote control including a display device capable of displaying a previously stored list of predefined functions involving the video display and the first video player and a user input device generating a first input and a second input based upon activation by a user, the first input selecting a function on the list and the second input indicating the current on/off status of at least one of the video display and the first video player, wherein the second input is received in response to a query regarding the on/off status of at least one of the video display and the first video player generated for the user on the display device, the remote control including a transmitter transmitting a wireless control signal to at least one of the video display and the first video player to toggle the switch to "on" if the second input from the user input device indicates that the switch is "off".

* * * * *